US005883320A

United States Patent [19]

Lashley

[11] Patent Number: 5,883,320

[45] Date of Patent: Mar. 16, 1999

[54] PEDAL GUITAR

[75] Inventor: Ronald T. Lashley, Burlington, N.C.

[73] Assignee: Emmons Guitar Company, Inc., Burlington, N.C.

[21] Appl. No.: 680,752

[22] Filed: Jul. 15, 1996

[51] Int. Cl.[6] ..... G10D 3/14

[52] U.S. Cl. ..... 84/312 P

[58] Field of Search ..... 84/312 P, 312 R

[56] References Cited

U.S. PATENT DOCUMENTS 3,422,716 1/1969 Alifano ..... 84/312 P
4,157,050 6/1979 Lashley ..... 84/312
5,044,247 9/1991 Stepp ..... 84/312

*Primary Examiner*—William M. Shoop, Jr.
*Assistant Examiner*—Kim Lockett

[57] ABSTRACT

A counter-force mechanism is provided for use with a stringed instrument, such as a pedal guitar, which neutralizes the adverse effects on adjoining strings during the sharpening or flattening of notes. In one embodiment the counter-force mechanism is affixed to the tone changer axle near the pickup and in another embodiment the counter-force mechanism is affixed at the opposite end to the head of the guitar in contact with the strings. Pull and push rods connected to the foot pedals and knee levers operate the counter-force mechanism automatically as the pedals and levers are used, as is standard while playing.

5 Claims, 6 Drawing Sheets

PEDAL GUITAR

FIELD OF THE INVENTION

The invention herein pertains to musical instruments and particularly to stringed musical instruments which utilize pedals or levers to make tonal (pitch) changes during playing.

BACKGROUND AND OBJECTIVES OF THE INVENTION

Stringed musical instruments such as guitars and in particular pedal guitars have innate structural weaknesses which translate into inadvertent variations of tonal sounds which are often unnoticed by the untrained ear and are generally tolerated by skilled musicians. During playing, pedals are depressed of both the foot and knee types which loosen or tighten a particular string or strings to selectively vary the tones produced. For example, a string may be tuned to a C note in the open condition and a designated pedal, when pressed will raise the tone of that particular string to a D note. A second pedal or lever attached to the same string may lower the tone from a C as contained in the open condition, to a B note. These changes occur as a mechanical action, in effect, either tightening or loosening the string while playing. While the limitations of such mechanical changes are normally accepted, the depression of a lever or pedal imparts additional forces which act on the structural integrity of the guitar, oftentimes with adverse results. Therefore, to obtain a D note with one string, other strings may also inadvertently receive some of the stresses and may decrease or increase in pitch.

Pedal guitar and other instrument manufacturers strive to eliminate inadvertent tonal defects and structural features which contribute to the tonal variations mentioned above, and the exact causes and/or structural designs are often debated. Thus, one purpose and objective of the present invention is to provide a mechanism to counter physical distortions or changes in a stringed musical instrument such as appear in a pedal guitar while playing to insure constant, uniform tonal quality and prevent inadvertent tonal (pitch) changes.

It is also an objective of the present invention to provide a mechanism to eliminate distortions of the instrument which affect the tonal (pitch) quality by the addition of a counter-force lever connector to the tone changer axle, in the preferred embodiment, which is attached through the counter-force lever to the foot pedals and knee levers as used for sharpening and lowering the pitch of the notes played.

It is another objective of the present invention to provide a counter-force mechanism which can be attached at the head end of the strings in a second embodiment.

It is still another objective of the present invention to provide a means for compensating for tonal changes of other strings which occur during the pressing of a lever or pedal to induce tonal changes in a particular string or strings.

Various other objectives and advantages of the present invention will become apparent to those skilled in the art as a more detailed description is set forth below.

SUMMARY OF THE INVENTION

A mechanism is presented for use with a stringed musical instrument which immediately counteracts physical distortions in the instrument which are inadvertently induced during playing. To sharpen or flatten the tonal quality of a string which has been tuned in the open position, a knee lever or foot pedal is usually pressed to accomplish the desired result. However, the stress created by depressing the pedal transfers through the instrument structure, so as to oftentimes undesirably vary the pitch of other strings. This inadvertent variation can create unwanted sounds and annoyances to both the musician and the audience. To neutralize such inadvertent tonal changes, a means to counteract such changes can be instantly realized by a mechanism which operates as a result of the pedal or lever depression.

In the preferred embodiment a counter-force lever connector joined to the conventional tone changer axle which maintains the strings at the pickup end and is pivotally affixed to a counter-force lever which in turn is joined to the pedal mechanism. Thus, as the musician depresses a particular pedal he obtains the tonal quality desired of the string played while simultaneously compensating for physical distortions within the instrument which may lower or increase the tonal pitch of adjacent strings. A second embodiment of the invention provides a counter-force mechanism affixed to the head of the instrument with means to contact the strings which likewise are affixed to a pedal or a lever. Again, when a pedal or lever is depressed the counter-force mechanism prevents strings, other than those desired, from inadvertently loosening or tightening so they will maintain their correct pitch.

DESCRIPTION OF THE PREFERRED EMBODIMENT

Figure 1:
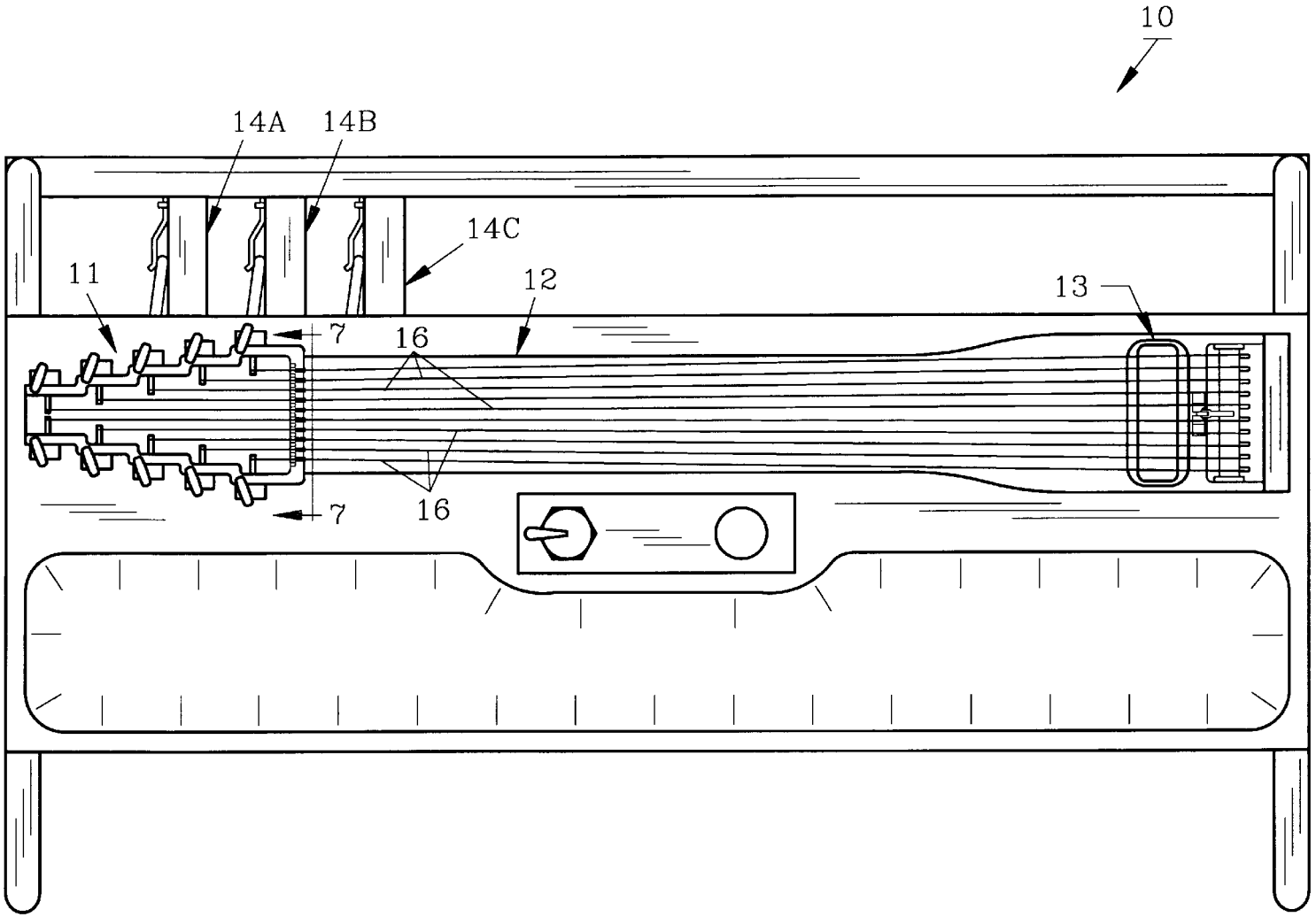
FIG. 1 illustrates a top view of a 10 string pedal guitar utilizing the preferred embodiment of the invention herein.
Figure 2:
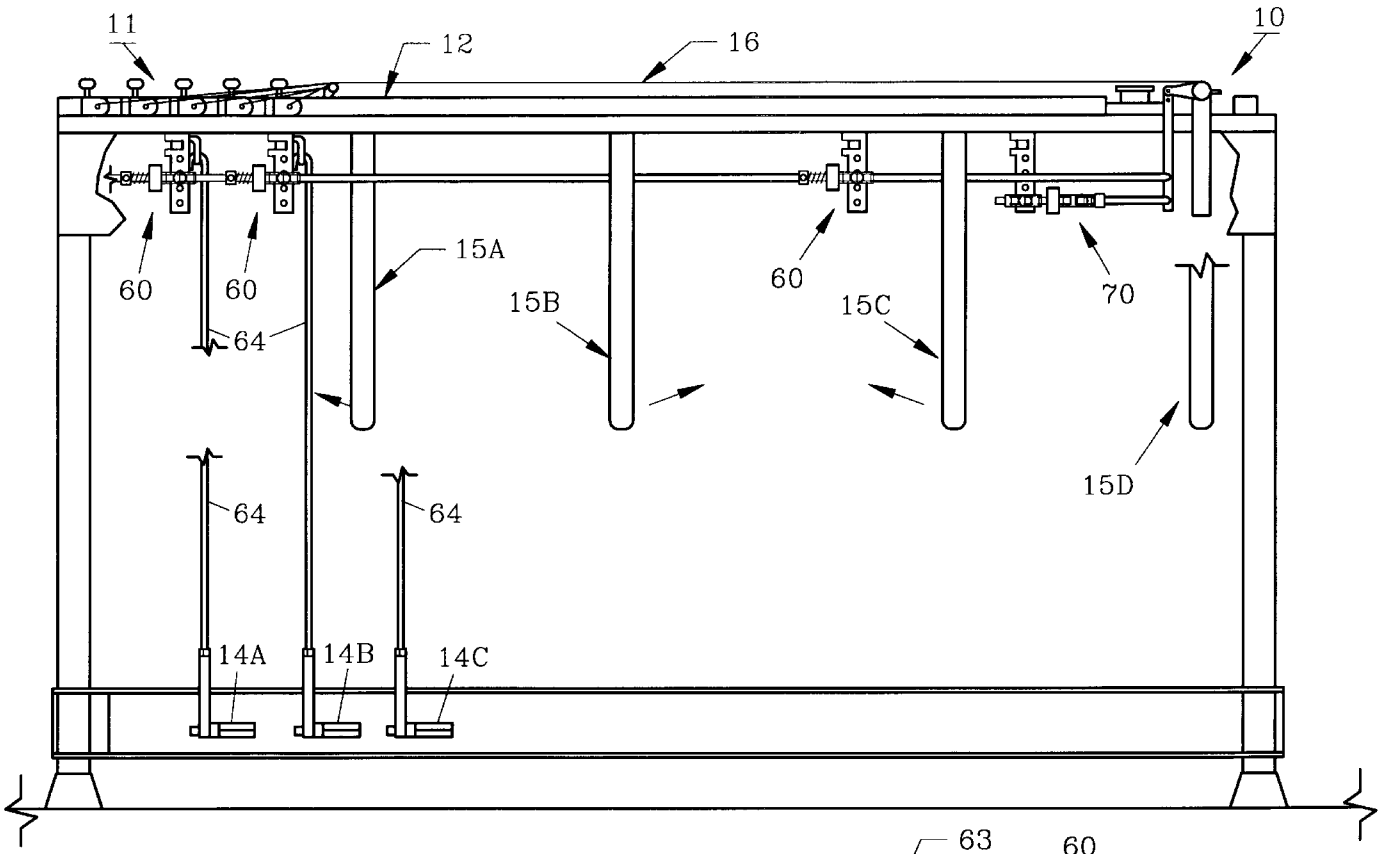
FIG. 2 shows a schematic side representation of the guitar as seen in FIG. 1 with portions cut away to better illustrate the invention.
Figure 3:
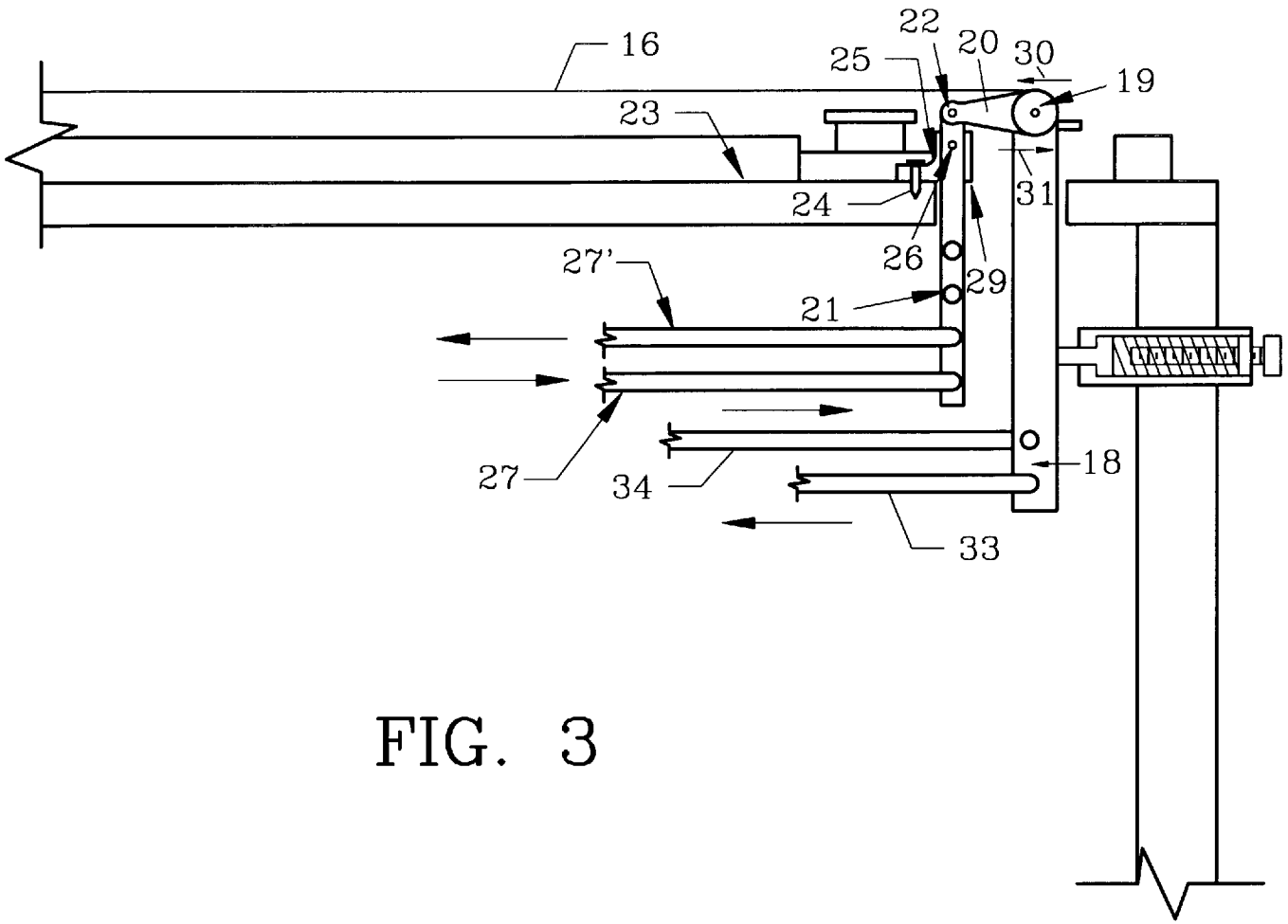
FIG. 3 features an enlarged schematic side view of certain components and additions to the invention of FIG. 2.
Figure 4:
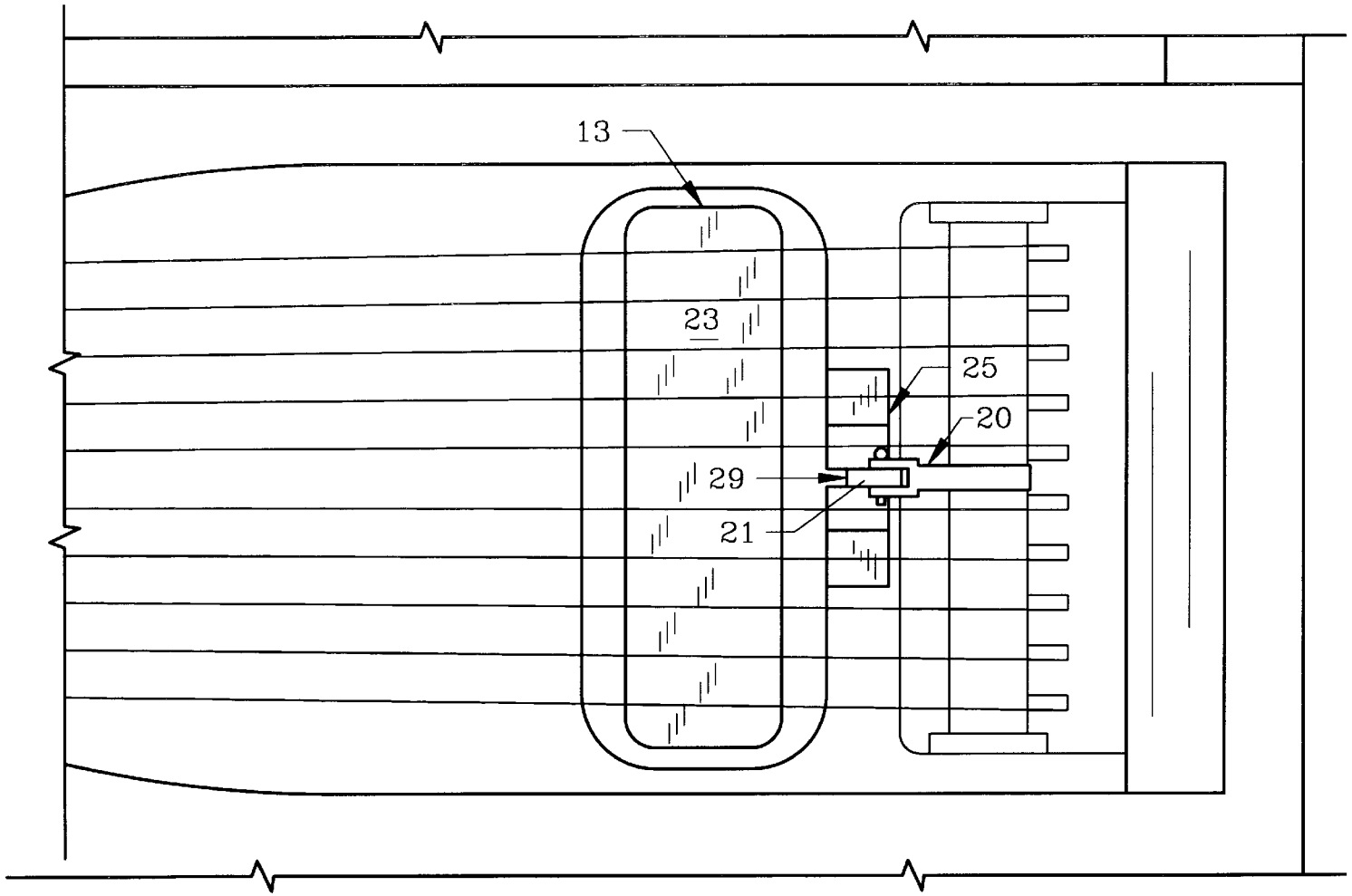
FIG. 4 depicts an enlarged top view of certain other components of the invention as seen in FIG. 1.

The preferred form of the invention is seen in FIGS. 1 through 4 and includes a tone counter-force lever connector which is affixed to the tone changer axle. A pivotable counter-force lever is joined to the counter-force lever connector as seen in FIGS. 2, 3 and 4. Depression of a selected foot pedal or knee lever activates a tone changer lever to vary the pitch of the selected string or strings while simultaneously the counter-force lever connector reacts to neutralize undesirable stresses on the guitar structure to prevent pitch variations of the other strings. Thus, as a string is played the musician may desire to sharpen or flatten the tone of a particular note by depressing, for example, the necessary foot pedal as is usual. When a foot pedal or knee lever is depressed, stresses are imparted to the guitar and particularly to the tone changer lever associated with the particular string which generates the desired note. However, in addition, stresses are inadvertently directed to the other strings due to imperfections and weaknesses in the proximate structural components of the instrument. As a result, the other strings may also increase or decrease in pitch slightly. Thus, the invention's counter-force lever mechanism helps to prevent such distortions and unwanted pitch changes by counteracting the stresses acting on the tone changer axle and on the other strings without additional effort on the musician's part.

The preferred mechanism includes a counter-force lever connector which is rigidly affixed to the tone changer axle, a counter-force lever which has a stationary and a movable pivot point for connection to the counter-force lever connector which is adjustably affixed to the foot pedal or knee lever activator. This counter-force mechanism allows the musician to play the instrument without the unwanted tone or pitch changes which always occur in conventional instruments.

DETAILED DESCRIPTION OF THE DRAWINGS AND OPERATION OF THE INVENTION

Figure 2A:
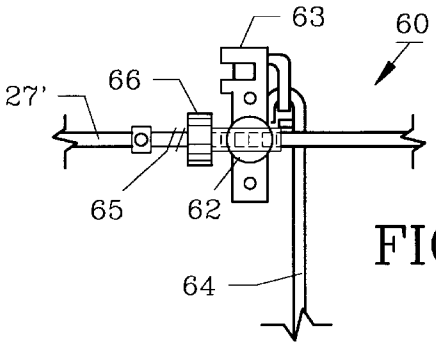
FIG. 2A pictures an enlarged view of a tunable counter-force assembly as activated by the foot pedal.

For a better understanding of the invention and its operation, turning now to the drawings which are generally schematic in nature for clarity purposes, FIG. 1 shows electric steel or pedal guitar 10, the preferred form, having a head 11 and a neck 12 with a conventional pickup 13 as is standard in the art. Pedal guitar 10 includes a trio of foot pedals 14A–14C and as shown in FIG. 2, with knee levers 15A–15D. Pedal guitar 10 includes ten strings 16 for producing different sounding notes which are varied by pedals 14 and knee levers 15 for different pitches during playing. FIG. 2A shows an enlarged view of one counter-force tuning assembly 60.

A musician playing guitar 10 utilizes foot pedals 14 and knee levers 15 to vary the pitch of selected notes emanating from strings 16. For example, by depressing pedal 14A, the pitch of a selected string is raised as the depression of pedal 14 tightens the selected strings by the clockwise rotation of changer lever 18 as seen in FIG. 3. Tone changer lever 18 rotates around changer axle 19 and in so doing, due to inherent structural weaknesses in guitar 10, causes adjoining strings 16 to loosen and to inadvertently lower in pitch. In contrast, when pedals 14 or levers 15 are operated to lower selected string or strings, inadvertent tightening of adjoining strings can cause them to rise in pitch. This unwanted pitch change caused by physical distortions in guitar 10 is of concern to the musician and of course is undesirable. To counteract or neutralize the unwanted stresses which are inadvertently received by adjoining strings, counter-force lever connector 20 is affixed to changer axle 19 and is pivotally joined to counter-force lever 21 at pivot point 22. Counter-force lever 21 is affixed to guitar frame member 23 by screws 24 passing through L-shaped bracket 25. As seen, counter-force lever 21 is rotatably affixed to bracket 25 at pivot point 26 whereby movement of counter-force lever 21 by push rod 27 causes pivot point 22 to slightly move and urge counter-force lever connector 20 forwardly as shown by arrow 30 or rearwardly by pull rod 27' as shown by arrow 31 in FIG. 3. As string 16 relaxes by the movement of rod 34 rearwardly, string 16 becomes looser and lowers in pitch. Counter-force lever connector 20 is simultaneously urged forwardly as shown by arrow 30 to maintain remaining strings 16 in their desired positions without inadvertent movement thereof. In the same manner, as rod 33 is pulled from right to left as seen in FIG. 3, tone changer lever 18 rotates in a clockwise direction around changer axle 19 causing string 16 to tighten, simultaneously therewith counter-force lever connector 20 moves from left to right as seen by arrow 31 to thus prevent any distortions in changer axle 19 to maintain proper pitch of the remaining strings. Either foot pedals 14A–14C or knee pedals 15A–15D will control counter-force lever 21 through the action of push rod 27 and pull rod 27'. In FIG. 4, a top view of L-shaped bracket 25 is seen with channel 29 therein which receives counter-force lever 21 as shown in FIG. 3. In counter-force tuner assembly 60 the amount of force exerted on rods 27' is determined by the adjustment of tuning screw 66 which is threadably adjustable through swivel 62, which is pivotally attached to bellcrank 63. Half spring 65 allows slack in the movement in the forward direction of pull rod 27' as push rod 27 is operated. Pull rod 27' passes through turning screw 66 which is threadably received within swivel 62.

Counter-force tuning assembly 70 as seen in FIG. 2, operates a counter-force tuning assembly 60, but in the opposite direction, that is to push rod 27 in a rearwardly direction.

Although only one lever 21 is shown in FIG. 3 which is operated by push rod 27 and pull rod 27', two levers (not shown) could instead be used, one for connection to push rod 27 and one for pull rod 27'.

Figure 5:
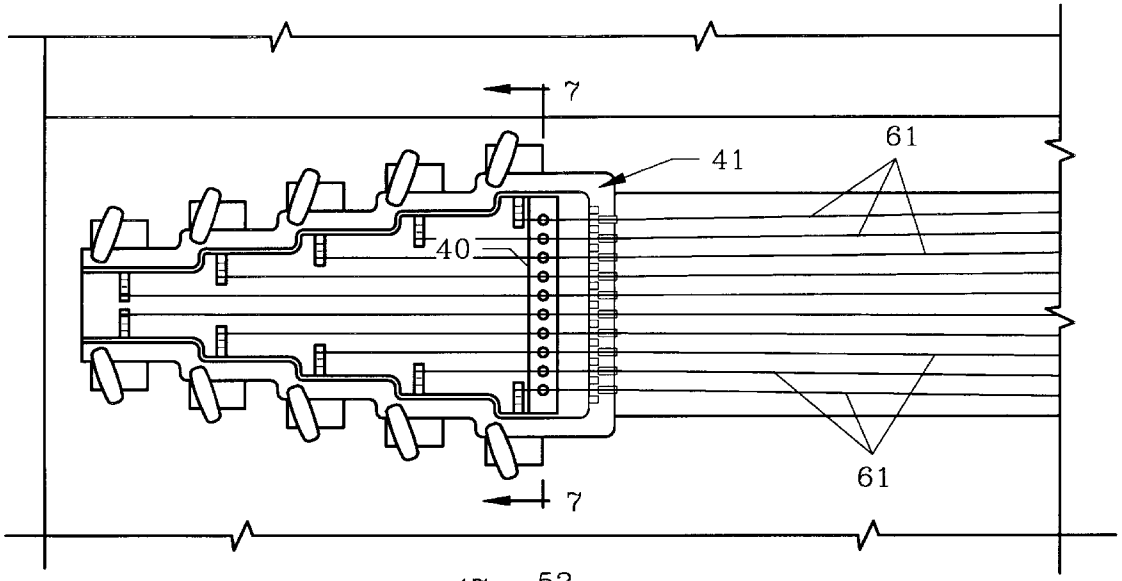
FIG. 5 demonstrates an enlarged head of the guitar as seen in FIG. 1 with another embodiment of the invention connected thereto.
Figure 6:
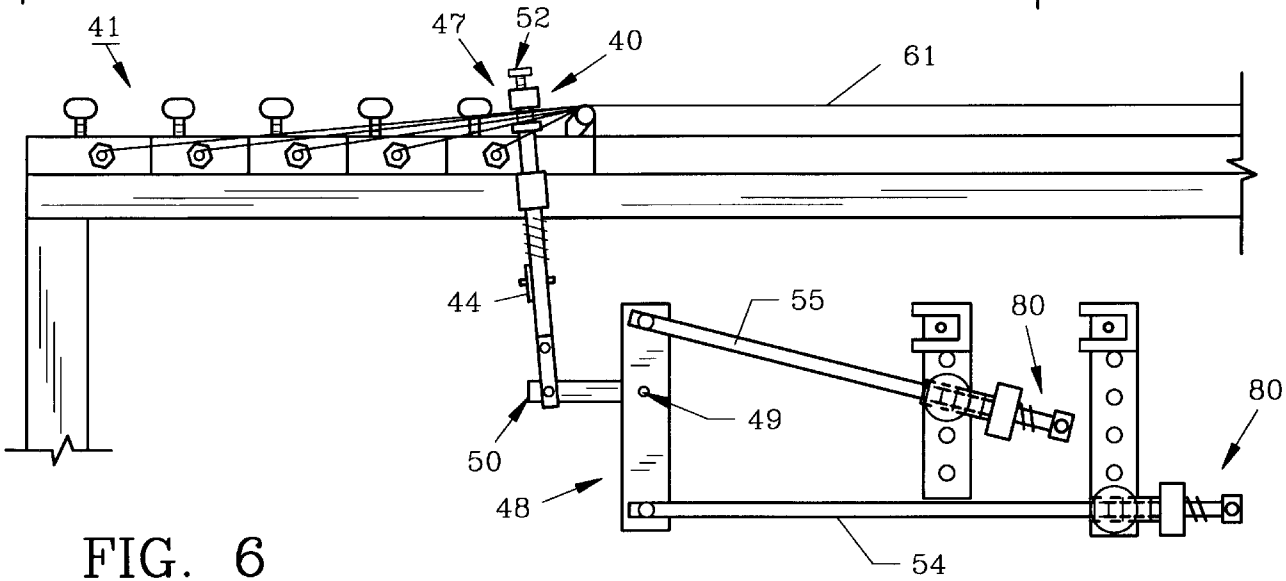
FIG. 6 is a schematic side elevational view of the head of the guitar as shown in FIG. 5.
Figure 7:
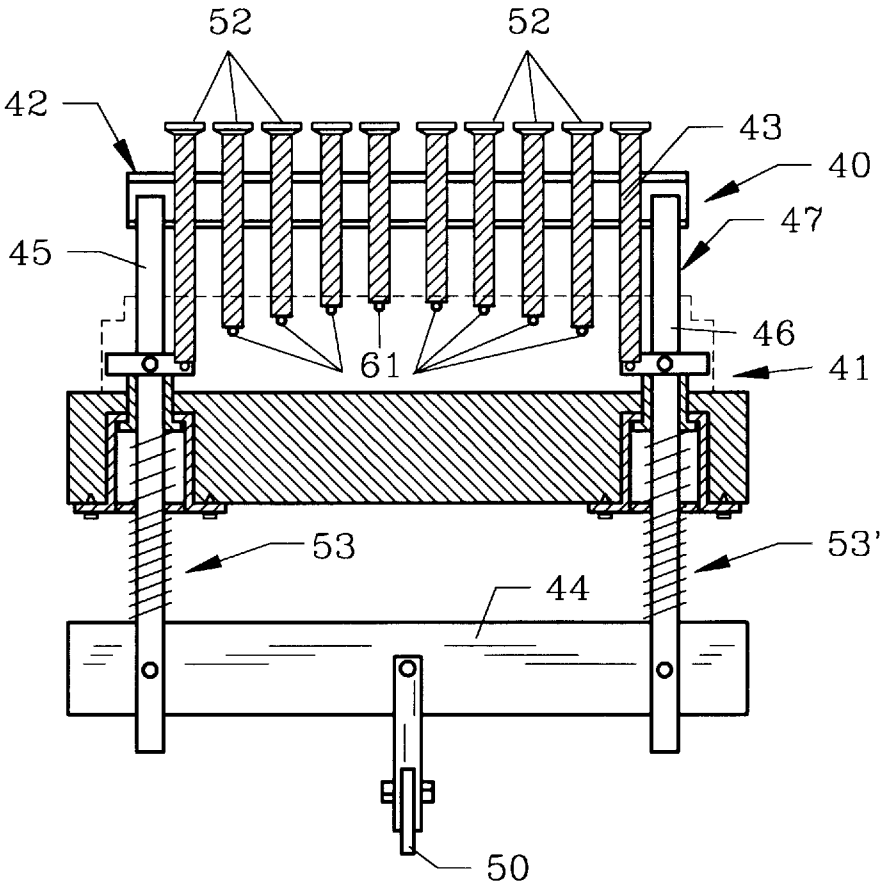
FIG. 7 illustrates the embodiment of the invention as shown in FIGS. 5 and 6 along lines 7—7 of FIG. 5.

In FIGS. 5–7 another embodiment of the invention is shown with counter-force mechanism 40 attached to head 41 of a conventional pedal guitar seen in a schematic format for clarity. Counter-force mechanism 40 is vertically movable and includes frame 42 as shown in FIG. 7 including upper transverse member 43, lower transverse member 44, left post 45 and right post 46 which are joined to form rectangular frame 47. Frame 47 is pivotally joined to bell crank 48 which includes a stationary pivot point 49 and a movable pivot point 50 (FIG. 6). Threaded adjusting members 52 are positioned within upper transverse member 43 and are placed to depress strings 61 when strings 61 are played in the open position with neither foot pedals or knee levers depressed. Frame 47 as shown in FIG. 7 is spring loaded by the positioning of coil springs 53, 53'. Thus, when counter-force mechanism 40 is activated by pressing either foot pedals or knee levers (not shown in FIG. 7) counter-force mechanism 40 returns to its original position. Counter-force mechanism 40 works in that counter force is applied to strings 61 through threaded members 52 as rod 54 (FIG. 6) is urged from left to right as shown in FIG. 6 to provide a tightening of strings 61 or, conversely, strings 61 are loosened if rod 55 is pulled from left to right as also shown in FIG. 6. Counter-force tuning assembly 80 as seen in FIG. 6 is adjustable in the same manner as counter-force tuning assembly 60, described in FIG. 2A.

The exact movement of the mechanisms shown herein can be varied and the exact structural components seen are merely for explanatory purposes and are not intended to limit the scope of the appended claims. For example, the invention herein will allow the tuning of pedal guitars to Bach's temper tuning as pianos are now conventionally tuned, as well as tuning the beats out of thirds on conventional pedal guitars.

I claim:

1. A mechanism to counteract inadvertent physical distortions of a stringed musical instrument occurring during induced pitch changes comprising: a pivotable counter-force lever connector, a tone changer axle, said counter-force lever connector rigidly joined to said tone changer axle, a pitch counter-force lever, said counter-force lever pivotally joined to said counter-force lever connector wherein physical distortions are neutralized by pivoting said counter-force lever whereby counteracting stresses acting on said tone changer axle.

2. The mechanism of claim 1 wherein said stringed musical instrument comprises a pedal guitar.

3. The mechanism of claim 1 wherein said counter-force lever connector is formed from stainless steel.

4. In a pedal guitar including a plurality of strings, each of said strings having an open position, a tightened position and a loosened position, each of said strings movable from said open position to either of said tightened or said loosened positions, a guitar frame member and a rotatable tone changer lever, said tone changer lever moving at least one of said strings from its open position to either its tightened position or its loosened position to induce a pitch change in said one string, an improvement for neutralizing physical distortions occurring during induced pitch changes, said improvement comprising:

a) a tone changer axle, said tone changer axle connected to said tone changer lever;

b) a counter-force lever connector, said counter-force lever connector rigidly joined to said tone changer axle;

c) a pitch counter-force lever, said counter-force lever pivotally joined to said counter-force lever connector, wherein rotating said tone changer lever moves said tone change axle and said counter-force lever connector thereby pivoting said pitch counter-force lever to neutralize physical distortions occurring during induced pitch changes;

d) a depressible foot pedal, said foot pedal indirectly connected to said tone changer lever, whereby depressing said foot pedal causes said tone changer lever to rotate around said tone changer axle; and e) a knee pedal, said knee pedal indirectly connected to said tone changer lever, whereby moving said knee pedal causes said tone changer lever to rotate around said tone changer axle;

wherein moving said counter-force lever maintains all but said one string in their open positions when said one string is moved to one of its tightened or loosened positions.

5. The pedal guitar of claim 4 wherein said counter-force lever connector is formed from stainless steel.

* * * * *